United States Patent [19]

Wepfer

[11] Patent Number: 4,768,582

[45] Date of Patent: Sep. 6, 1988

[54] STEAM GENERATOR WRAPPER ACCOMMODATING TUBE SUPPORT MEMBERS OF HIGH THERMAL EXPANSION COEFFICIENT MATERIAL

[75] Inventor: Robert M. Wepfer, Wilkinsburg, Pa.

[73] Assignee: Westinghouse Electric Corp., Pittsburgh, Pa.

[21] Appl. No.: 65,123

[22] Filed: Jun. 19, 1987

Related U.S. Application Data

[63] Continuation of Ser. No. 694,191, Jan. 23, 1985, abandoned.

[51] Int. Cl.[4] ..... F28F 7/00

[52] U.S. Cl. ..... 165/82; 165/162; 376/285

[58] Field of Search ..... 376/285, 286; 165/81, 165/82, 162

[56] References Cited

U.S. PATENT DOCUMENTS

| | | | |
|---|---|---|---|
| 2,910,219 | 10/1959 | Bennett et al. . | |
| 3,494,414 | 2/1970 | Warner | 165/82 |
| 3,841,593 | 10/1974 | Muto et al. | 248/146 |
| 3,850,795 | 11/1974 | Thome | 176/50 |
| 4,267,020 | 5/1981 | Burack | 165/76 |
| 4,415,021 | 11/1983 | Bayless | 165/162 |
| 4,503,903 | 3/1985 | Kramer | 165/162 |
| 4,583,584 | 4/1986 | Wepfer | 376/285 |

FOREIGN PATENT DOCUMENTS 2828275 1/1980 Fed. Rep. of Germany .

*Primary Examiner*—Frederick R. Schmidt
*Assistant Examiner*—Bradley I. Vaught
*Attorney, Agent, or Firm*—Donald M. Satina

[57] ABSTRACT

Slots are provided in the wrapper of a nuclear steam generator to increase the local flexibility of the wrapper to allow for the difference in thermal expansion between the carbon steel wrapper and the high corrosion resistant alloy tube support members. The radial structural load paths between the tube support members, the wrapper, and the outer shell provided by the radial support means, about which the expansion slots are provided, are not affected by the addition of the expansion slots. Since the slots are preferably provided by means of a high speed industrial laser, they are very thin and do not permit substantial commingling of cooler downcomer water and the boiling mixture in the tube bundle region. The expansion slots may be vertically or horizontally oriented and may be cut into the wrapper on more than one side of the radial support means. The slots may end in small curved portions to decrease stress concentrations and increase fatigue life.

8 Claims, 4 Drawing Sheets

STEAM GENERATOR WRAPPER ACCOMMODATING TUBE SUPPORT MEMBERS OF HIGH THERMAL EXPANSION COEFFICIENT MATERIAL

This application is a continuation of application Ser. No. 694,191 filed Jan. 23, 1985 now abandoned.

BACKGROUND OF THE INVENTION

This invention relates to heat exchangers and, more particularly, to a design which reduces thermally induced loads in the tube support plates and the tube bundle wrapper of a nuclear steam generator.

A typical steam generator for a pressurized water nuclear reactor comprises a vertically oriented heavy wall rolled cylindrical shell, a thin wall round wrapper portion disposed within the shell portion and spaced therefrom, a plurality of U-shaped tubes disposed within the wrapper portion so as to form a tube bundle, a tube sheet for supporting the tubes at the ends opposite the bent sections thereof, a plurality of generally parallel tube support members longitudinally spaced within the wrapper portion and having a plurality of holes through which the tubes pass, and a plurality of individual radial support means angularly spaced about the wrapper portion and associated with the shell and wrapper for radially constraining the tube support members.

Each radial support means includes a jacking block, which is welded into the wrapper, and jacking screws which are threaded through holes in the jacking block to align and support the wrapper within the shell, creating an annular space between the shell and wrapper. The jacking screws are then welded to the jacking block. The tube support members or plates are then positioned within brackets which provide longitudinal support. Wedges are driven between the jacking blocks and the side edges of the support plates while in the unheated shop condition and then welded, creating a structural load path between the support plates and the shell. The load path transmits dynamic loads, which may occur during steam generator handling and shipping or from seismic events, from the tube bundle to the shell, thereby inhibiting yielding of any of the tube bundle or tube support members.

Nuclear steam generators are subject to a variety of corrosion mechanisms. At the intersections of the tube support members with the tubes, the corrodents present in the secondary side water tend to concentrate to the detriment of both the tubes and the tube support members. Use of a support member with improved corrosion resistance will also reduce tube corrosion. However, materials with higher corrosion resistance will generally contain higher amounts of nickel and chromium than carbon steel, resulting in higher coefficients of thermal expansion. As the steam generator is heated to operating temperature, the greater expansion of the corrosion resistant tube support members versus that of the carbon steel wrapper results in undesirable and usually unacceptable stress levels in the tube support members and in the wrapper. Such stresses could lead to local yielding.

Therefore, what is needed is a steam generator which can accommodate the difference in thermal expansion between the tube support members and the wrapper without inducing unacceptably high stresses in the steam generator components while maintaining a rigid radial structural load path between the tube support members and the shell.

SUMMARY OF THE INVENTION

There are provided thin expansion slot means in the wrapper means surrounding the tube bundle in a nuclear steam generator to compensate for differences in thermal expansion between alloy tube support members and a carbon steel wrapper. A typical nuclear steam generator comprises a vertically oriented heavy wall cylindrical shell means, a thin wall wrapper means disposed within the shell portion, a plurality of U-shaped tubes disposed within the wrapper portion to form a tube bundle, a tubesheet means for supporting the tubes, a plurality of generally parallel tube support members longitudinally spaced within the wrapper portion and having a plurality of apertures through which the tubes pass, and a plurality of individual radial support means associated with the shell means and the wrapper means for radially constraining the tube support members.

The thin wall wrapper means is comprised of steel having a predetermined coefficient of thermal expansion. The tube support members are comprised of a highly corrosion resistant alloy having a predetermined coefficient of thermal expansion which is greater than the coefficient of the thin wall wrapper means. At operating temperature, the thermally induced stresses resulting from the differences in thermal expansion would be unacceptably high.

Elongated thin slot means are provided proximate at least the majority of said radial support means to provide additional radial movement or growth capabilities for the thin wall wrapper means during steam generator operation to compensate for the differences in thermal expansion. The expansion slot means are spaced from the radial support means to provide uninterrupted wrapper material immediately proximate the radial support means for continued integral attachment.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

The invention will be described as applied to a steam generator in a pressurized water reactor (PWR) nuclear power plant; however, it is to be understood that it is also applicable to other tubular heat exchangers.

Figure 1:
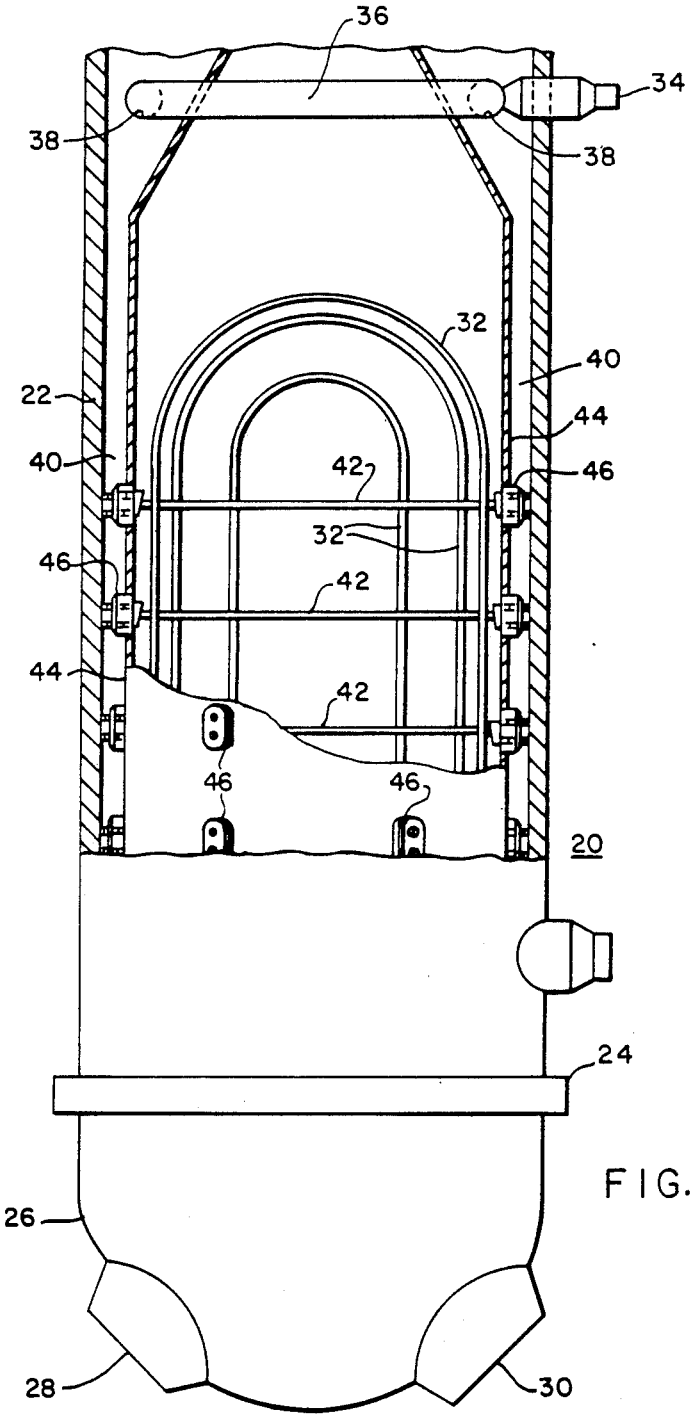
FIG. 1 is a fragmentary elevational view, with parts broken away, of a steam generator for a PWR power plant.

Referring to FIG. 1, the steam generator 20 for a PWR has a generally cylindrical shell 22 which terminates below a horizontal tubesheet 24 in a hemispherical housing 26 having an inlet 28 and an outlet 30 for reactor coolant. Reactor coolant enters inlet 28, circulates through hundreds of U-shaped tubes 32 (only three shown for clarity), and is discharged through the outlet 30 in a manner wellknown in the art. Feedwater entering through feedwater inlet 34 distributes through feedwater ring 36, discharges through nozzles 38, and down through annulus 40 to just above the tubesheet 24. The water turns radially inward at the tubesheet, rises and circulates in the shell around the U-shaped tubes 32 which carry the hot reactor coolant and is converted to steam which rises into demisters (not shown) above the U-shaped tubes before being discharged for use in driving a turbine-generator combination.

Within the shell 22 are tube support means 42 which preferably are formed as support plates. Surrounding the U-shaped tubes 32 and tube support plates is a cylindrical wrapper means 44 which ends just above the tubesheet 24 such that the mixture of feedwater and recirculating water is introduced within the wrapper into contact wtih the tubes. Collectively, these components are referred to as the internals.

Figure 2:
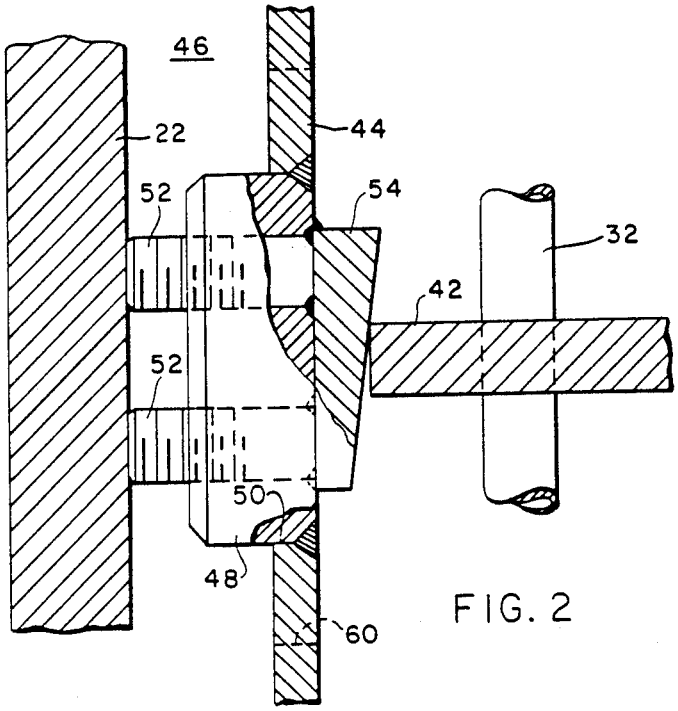
FIG. 2 is a fragmentary elevational view with parts broken away taken along the line II—II in FIG. 3.

A direct load path between the wrapper 44 and the shell 22 for seismic forces is provided by radial support means 46, which are longitudinally positioned at the tube support means and angularly distributed around the gap or annulus 40 between the wrapper 44 and the shell 22. As depicted in FIG. 2, the radial support means may be comprised of jacking blocks 48 welded into apertures 50 in the wrapper 44 and jacking screws 52 which are threaded into engagement with the shell 22 and welded in place. Wedges 54 may be driven between the support means 42 and wrapper 44 at the locations of the radial support means 46 to complete the structural load path between the tube support means and the shell 22.

The wrapper 44 is preferably comprised of carbon steel having a typical mean expansion coefficient of $7.2\times10^{-6}$ in/in-°F. in the temperature range of interest. Tube support means 42 is preferably comprised of material of higher corrosion resistance and will generally have a higher coefficient of thermal expansion than carbon steel, and example being Type 347 stainless steel which typically has mean expansion coefficient of $9.8\times10^{-6}$ in/in-°F. in the temperature range of interest. Since the wedges 54 are driven between the tube support means 42 and the wrapper 44 while all parts are in the unheated condition, thermal interaction at operating temperatures between the higher coefficient of expansion tube support plates and the carbon steel wrapper results in undesirable and usually unacceptable stress levels in the support plates and wrapper.

Figure 3:
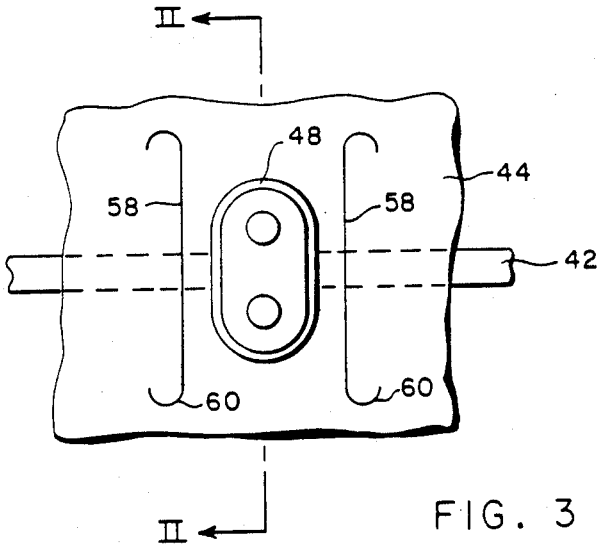
FIG. 3 is a fragmentary elevational view of a preferred embodiment of the present invention.

As depicted in FIG. 3, very thin expansion slot means 58 are cut in the wrapper 44 according to this invention for increasing the local flexibility of the wrapper, thereby reducing the thermally induced stresses in the tube support means and wrapper while maintaining a structural load path between the tube support means and the shell 22, thereby preventing localized yielding of the wrapper 44. In the preferred form of the invention, expansion slots 58 approximately 0.035 inch (0.9 mm) wide in the shape depicted in FIG. 3 are cut into the 0.375 inch (0.95 cm) thick wrapper 44 with a high-power industrial laser. As an example, the expansion slots 58 are vertically oriented and are cut into the wrapper 44 on either side of the jacking blocks 48 and within one inch (2.54 cm) therefrom and extend about 10 inches (25.4 cm) above and below the tube support means 42. The expansion slots may end in small curved portions 60 for improvement of fatigue life by reduction of stress concentrations at the ends of the slots. The expansion slots need not be made around each radial supporting means 46 but should be provided proximate at least two-thirds of the locations.

Figure 4:
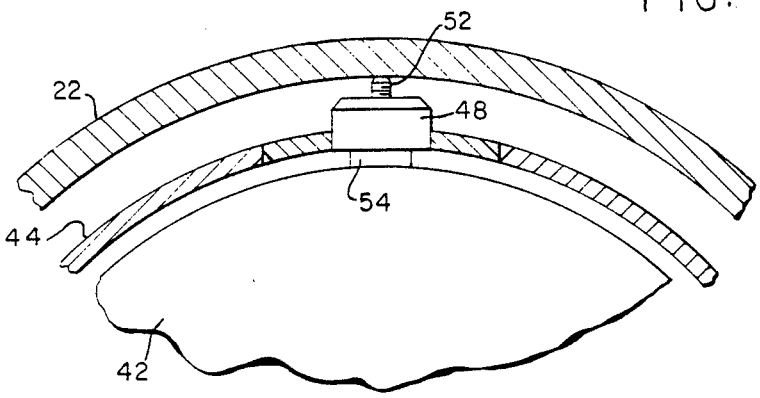
FIG. 4 is a fragmentary cross-sectional view through a tube support means, wrapper, radial support means, and shell illustrating the relative positions of said components when the steam generator is in the cold, depressurized condition.
Figure 5:
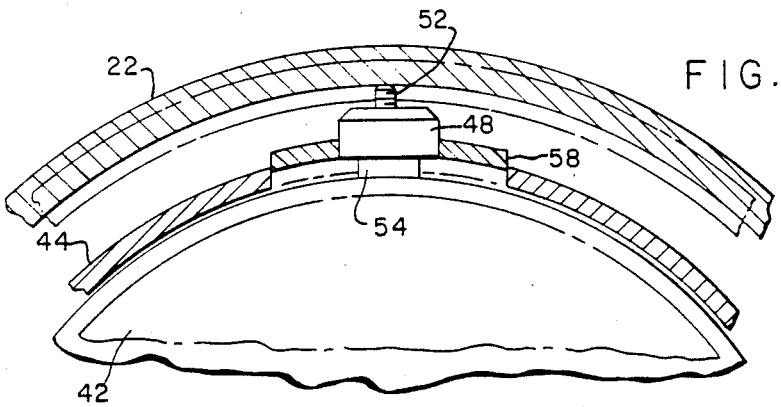
FIG. 5 is a fragmentary cross-sectional view corresponding to FIG. 4 but with the steam generator at operating temperature and pressure depicting the increased flexibility in the wrapper resulting from incorporation of the present improved design.

As the steam generator is started up and the components become heated, the tube support means 42 expand more radially than can be accommodated by the lesser expanding circumference of the wrapper 44. As depicted in FIGS. 4 and 5, the expansion slots 58 permit flexing of the portions of the wrapper 44 surrounding the jacking block 48 between the slots with respect to the remainder of the wrapper while retaining sufficient strength in the wrapper for support of the tube support means 42. Pressure and thermal expansion cause the shell 22 to expand enough that little or no stress is imparted on the shell by the jacking screws 52 and the expanding tube support means 42. Due to the very small width of the slot achievable with a laser beam cutter, commingling of cold and heated feedwater by flow of water from the gap or annulus 40 through the slots in the wrapper is minimal.

The expansion slots preferably extend through the full width of the wrapper. The slots can be cut at various angles through the wrapper with the preferred embodiment specifying slots cut parallel to the radius between the wrapper center to the center of the radial support device, such angle being observable in FIGS. 4 and 5. The expansion slots may be made narrower by machining the wrapper at the proposed slot sites before cutting.

Figure 6:
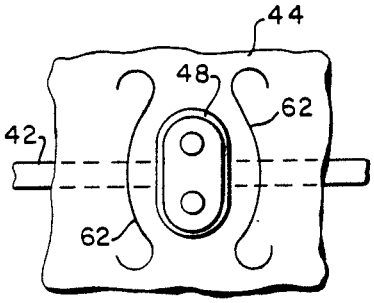
FIG. 6 is a fragmentary elevational view of another embodiment of the present invention.

In another embodiment of the invention, which is shown in FIG. 6, the expansion slots 62 are curved to more closely follow the contour of the jacking blocks 48, increasing local flexibility.

Figure 7:
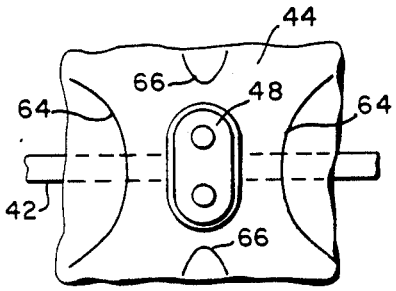
FIG. 7 is a fragmentary elevational view of a further embodiment of the present invention.

Flexibility can be increased while maintaining support strength by using multiple slots as illustrated in FIG. 7. Such an embodiment incorporates elongated curved slot portions 64 which are generally vertically disposed and short curved slot members 66 above and below the jacking blocks 48. Curved ends (not shown) can be employed to reduce stress concentrations, increasing fatigue life.

Figure 8:
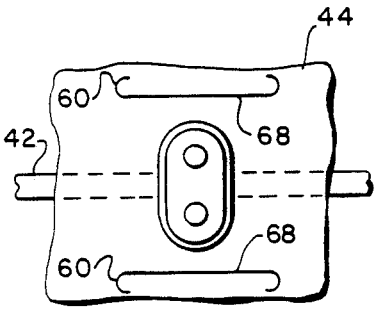
FIG. 8 is a fragmentary elevational view of still another embodiment of the present invention.

Another embodiment, depicted in FIG. 8, employs circumferential slots 68 rather than longitudinal slots. The slots may end in small curved portions 60 for fatigue purposes.

Figure 9:
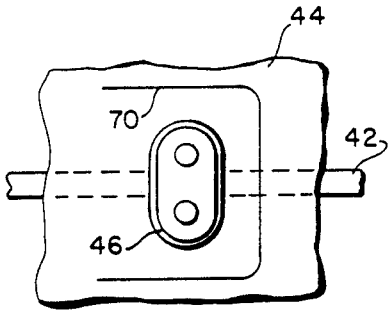
FIG. 9 is a fragmentary elevational view of yet another embodiment of the present invention.

FIG. 9 represents still another embodiment with one continuous slot 70 around two or three sides of the radial support means 46. Small end radii (not shown) may be employed as previously described.

While there is described what are now considered to be the preferred embodiments of the invention, it is, of course, understood that various other modifications and variations will occur to those skilled in the art.

While a high-power laser is preferred for machining the elongated and narrow slot members as described hereinbefore, it should be understood that other machining techniques could be substituted therefor.

I claim as my invention:

1. An improved steam generator for a pressurized water nuclear reactor, said steam generator comprising: a vertically oriented heavy wall cylindrical shell means, a thin wall wrapper means disposed within said shell means and closely spaced therefrom to form an annulus between the outside of said wrapper and the inside of said shell means, a plurality of U-shaped tubes disposed within said wrapper means to form a tube bundle, a tubesheet means for supporting said tubes proximate the ends which are opposite the bent sections thereof, a plurality of generally parallel tube support members longitudinally spaced within said wrapper means and having a plurality of apertures through which said tubes pass, and a plurality of individual radial support means associated with said shell means and said wrapper means for radially constraining said tube support members, said thin wall wrapper means extending from a location between said tubesheet means and said tube support member nearest said tubesheet means vertically away from said tubesheet means beyond said tube support member farthest from said tubesheet means, said thin wall wrapper means comprised of steel having a predetermined coefficient of thermal expansion, wherein the improvement comprises providing said tube support members of highly corrosion resistant alloy having a predetermined coefficient of thermal expansion which is greater than the coefficient of said thin wall wrapper means and providing elongated thin expansion slot means extending through said wrapper means proximate at least the majority of said radial support means to provide additional flexing capabilities for said thin wall wrapper means during steam generator operation to compensate for the differences in thermal coefficients between said thin wall wrapper means and said alloy tube support members to reduce the thermally induced stresses in said tube support members and said wrapper means while maintaining a structural load path between said tube support members and said shell means, thereby preventing localized yielding of said wrapper means, said thin expansion slot means being spaced from said radial support means to provide uninterrupted wrapper material immediately proximate said radial support means for structural protection during seismic occurrences, said slot means being of a predetermined very small width to minimize comingling of cold water flowing through said annulus and heated water flowing within said wrapper means while permitting flexing of said uninterrupted wrapper material immediately proximate said radial support means.

2. The steam generator according to claim 1 wherein said expansion slot means are provided in the wrapper means proximate at least two-thirds of said radial support means.

3. The steam generator according to claim 2 wherein said expansion slot means are provided proximate all of said radial support means to provide additional expansion capabilities for said wrapper means.

4. The steam generator according to claim 3 wherein one expansion slot means is provided on each of two sides of all of said radial support means.

5. The steam generator according to claim 4 wherein said expansion slot means in said wrapper means are substantially perpendicular to said tube support members, and said slot means extend above and below the wrapper intersection of said tube support members and said radial support means.

6. The steam generator according to claim 5 wherein the expansion slot means are provided with curved end portions to decrease stress concentrations, thereby increasing fatigue life.

7. The steam generator according to claim 6, wherein said expansion slot means are approximately 0.035 inch wide.

8. The steam generator according to claim 7, wherein said expansion slot means are spaced within one inch from said radial support means at the intersection of said tube support members and said radial support means and said slot means extend about 10 inches above and below the wrapper intersection of said tube support members and said radial support means.

* * * * *